US005567743A

United States Patent [19]

Busby et al.

[11] Patent Number: 5,567,743

[45] Date of Patent: Oct. 22, 1996

[54] RECLAMATION OF ESTER-CURED PHENOLIC RESIN BONDED FOUNDRY SANDS

[75] Inventors: Andrew D. Busby; Philip Vernon, both of Kidderminster, England

[73] Assignee: Asland Inc., Columbus, Ohio

[21] Appl. No.: 392,980

[22] PCT Filed: Aug. 23, 1993

[86] PCT No.: PCT/GB93/01792

§ 371 Date: May 12, 1995

§ 102(e) Date: May 12, 1995

[87] PCT Pub. No.: WO94/05448

PCT Pub. Date: Mar. 17, 1994

[30] Foreign Application Priority Data

Sep. 2, 1992 [GB] United Kingdom ..... 9218596

[51] Int. Cl.[6] ..... B22C 1/02; B22C 9/02; C08K 3/34

[52] U.S. Cl. ..... 523/143; 523/145; 523/146; 523/147; 524/594; 524/595; 528/144; 528/239

[58] Field of Search ..... 523/143, 145, 523/146, 147; 524/594, 595; 528/144, 239

[56] References Cited

U.S. PATENT DOCUMENTS

| | | | |
|---|---|---|---|
| 5,211,215 | 5/1993 | Sommer | 241/DIG. 10 |
| 5,238,976 | 8/1993 | Iyer | 523/145 |
| 5,376,696 | 12/1994 | Dunnavant et al. | 523/145 |

*Primary Examiner*—Paul R. Michl
*Assistant Examiner*—Olga Asinovsky
*Attorney, Agent, or Firm*—David L. Hedden

[57] ABSTRACT

This invention relates to a process for reclaiming ester-cured phenolic resin bonded sand. The process comprises contacting attrition reclaimed sand with a compound which converts potassium compounds to a form having a melting point of least 550° C., and then thermally treating the sand at a temperature below that which the resulting potassium compound fuses.

10 Claims, No Drawings

RECLAMATION OF ESTER-CURED PHENOLIC RESIN BONDED FOUNDRY SANDS

FIELD OF INVENTION

This invention relates to the reclamation of foundry sands from used foundry moulds which have been fabricated by bonding foundry sand with ester-cured phenolic resin binders.

BACKGROUND OF THE INVENTION

There is an increasing demand to recycle foundry sands from moulds after casting. The demand is fuelled not only by the cost of virgin sand but also by the problems associated with the disposal of the used resin coated sand. In the past such material was readily disposed of in land fill sites but recently the authorities have become more environmentally conscious and in many regions there are strict regulations governing the disposal of such materials.

One known method of sand reclamation comprises attrition of the bonded sand to break up the agglomerates into individual particles. Whilst the attrition process may remove some resin from the sand particles by abrasion which will be removed with the fines, resin remains on the surface of sand particles and the re-bonding properties of the attrition reclaimed sand are inferior to the bonding properties of new sand. Generally, conventional attrition techniques allow re-use of up to 85% of the resin bonded sand, the remaining sand being dumped.

Known thermal techniques for reclaiming foundry sand after attrition comprise heating the sand in a fluidised bed to a sufficiently high temperature to remove the organic resin effectively and to ensure low emissions from the exhaust gas. However, it has been found that such a thermal reclamation process is not particularly successful with ester-cured bonded foundry sands because there is a tendency for the sand grains to agglomerate in the thermal reclaimer preventing efficient operation of the fluidised bed at temperatures high enough to remove the binder effectively and ensure low emissions. At low temperatures there is inefficient removal of the resin. Sand reclaimed by the known thermal techniques exhibits re-bonding properties inferior to new sand and comparable to sand reclaimed by attrition.

It is believed the problem of agglomeration in the thermal reclamation system is due to the presence of potassium in the resin binder system which is generally in the form of potassium hydroxide and associated ester salts. It is postulated that the potassium compounds decompose and/or melt during the thermal treatment which results in agglomeration of sand particles, the particles being bonded or attracted to each other to such an extent that the fluidising gas is unable to maintain an effective fluidised bed.

The potassium compounds could be removed by washing the foundry sand prior to thermal treatment. However, such washing would significantly increase the energy requirements to dry and thermally treat the washed sand that such a procedure would be uneconomic.

SUMMARY OF THE INVENTION

It is an object of the present invention to provide an improved reclamation process for ester-cured phenolic bonded foundry sands.

Therefore according to the present invention there is provided a process comprising the thermal treatment of attrition reclaimed ester-cured phenolic resin bonded sand in which prior to the thermal treatment the attrition reclaimed sand is contacted with an additive which converts potassium compounds to a form having a melting point of at least 600° C. and the thermal treatment is effected at a temperature below that at which the resulting potassium compound fuses.

DESCRIPTION OF THE PREFERRED EMBODIMENT(S)

It has been found that by converting the potassium hydroxide and other salts in the ester-cured resin system to a potassium compound having a melting point above 550° C., and preferably above 700° C., the sand can be thermally processed at sufficiently high temperatures to remove the resin coating effectively and ensure low emissions but without agglomeration of the sand. Furthermore, there is a significant reduction in the potassium content of the coated sand after the thermal treatment and the resulting sand exhibits rebonding properties superior to attrition reclaimed sand and often comparable to new sand. The process also allows recycling of more sand than with conventional techniques.

There are a number of potassium compounds having a melting point above 550° C. including the antimonide (812° C.), metaborate (947° C.), chloride (776° C.), chromate (975° C.), fluoride (880° C.), iodide (723° C.), molybdate (919° C.), orthophosphate (1340° C.), metaphosphate (807° C.), silicate (976° C.) and sulphate (1069° C.), bromide (730° C.) and carbonate (891° C.).

According to one preferred embodiment of the invention, the additive is in the form of an aqueous solution of a compound which will react with potassium hydroxide to yield such a potassium compound. Suitable acid or salt solutions for use as an additive include halogen acids, e.g. HCl, HBr, HI, sulphuric acid, boric acid, and ammonium salts of such acids such as, ammonium chloride.

However we have found that the additive need not necessarily be added as a solution. Some possible additives are not really soluble and additionally in some circumstances it may be advantageous to use completely dry sand in the thermal treatment step. In these cases it is possible to make the addition as a finely dispersed powdered solid. Examples are calcium compounds such as the sulphate and clays with a base exchange capability. Thus, calcium sulphate would convert the potassium compounds to potassium sulphate of high melting point whilst the calcium oxides would form as a fine powder which would disperse with the fines from the fluidising bed.

The amount of additive employed is preferably at least that required to convert all the potassium in the resin to the thermally stable form. In the case where the additive is added as an aqueous solution, the amount added will depend upon the concentration of the solution. Generally the amount of the additive will be at least 0.25% by weight of the sand and preferably from 0.5 to 5% by weight of the sand. When the additive is added as an aqueous solution the amount is generally selected to be sufficient to wet all the sand particles (at least about 0.25 to 0.5% by weight of the sand) but not in large amounts which would significantly increase the energy requirements for drying and thermally treating the sand. The maximum amount of aqueous additive is generally less than 5% by weight of sand. Preferably the aqueous additive is used in an amount of about 2.5% by weight of sand.

The aqueous solution of the additive may additionally include a surfactant, e.g. sodium salts of sulphated fatty alcohols, to improve the wetting of the sand particles.

The additive may be added to and mixed with the sand in a conventional mixer. Conveniently the additive may be mixed with the sand in the screw conveyor feeding a thermal reclaimer.

Thermal treatment may be conducted in any known type of thermal reclaimer employing any known heating technique. Generally reclaimers in which the sand is fluidised and heated, generally using a gas fired fluidised bed, are preferred. The sand is generally heated to a temperature in the range of 600° C. to 1000° C., usually 700° C. to 800° C., with a stack temperature of about 1100° C. to ensure clean burning and low emissions. The dwell time in the thermal reclaimer may vary but adequate results have been obtained with a dwell time of 30 minutes.

The invention will now be illustrated by the following Examples according to the invention and Comparative Examples.

All the Examples and Comparative Examples employed attrition reclaimed sand taken from a commercial foundry. The sand contained residues of ester-cured alkaline phenolic resin, the original foundry binder comprising Novaset 720 phenolic resin and Novaset 6 Hardener (triacetin/γ-butyrolactone 50:50) commercially available from Ashland Chemical Limited.

The thermal treatment was carried out in a Richards gas fired, fluidised bed thermal reclaimer having a throughput of about 300 kg per hour. The residence time of sand in the thermal reclaimer was about 30 minutes.

EXAMPLE 1

Attrition reclaimed sand was pre-mixed with 2.5% by weight of a 10% aqueous solution of hydrochloric acid in a continuous sand mixer screw-type conveyor and charged into the fluidised bed thermal reclaimer having an average bed temperature of 730° C.

Loss on ignition, potassium content and bonding tests were conducted on attrition reclaimed sand, thermally reclaimed sand and new sand. The bonding tests were conducted according to AFS Standard Compression Strength Test using Novaset 726 alkaline phenolic resin (1.5% by weight of sand) and Novaset 6 hardener (25% by weight of resin). The results are reported in the following Table.

| | Attrition Reclaimed Sand | Thermally Reclaimed Sand | New Sand |
|---|---|---|---|
| Loss on ignition | 1.8% | 0.1% | 0.2% |
| Potassium | 0.12% | 0.07% | 0.01% |
| Compression Strengths (psi) | | | |
| 1 hour | 87 | 105 | 91 |
| 2 hours | 105 | 178 | 164 |
| 4 hours | 152 | 312 | 228 |
| 24 hours | 163 | 392 | 440 |

The thermally reclaimed sand was analyzed for chloride ion content. This was found to be 0.05%. The stoichiometric ratio of potassium to chloride ions would be 1.1:1 for 100% KCl. On the basis of our results it would appear that about 80% of the remaining potassium is present as the chloride.

It should be noted that the potassium analysis determines only "free" potassium and does not detect the potassium complexes known to be present within the mineral structure of new (virgin) sand.

EXAMPLE 2

Adopting the same procedures as in Example 1 attrition reclaimed sand was pre-mixed with 2.5% by weight of a 10% aqueous solution of ammonium chloride. The sand was then charged into the fluidised bed thermal reclaimer with an average bed temperature of 730° C.

Results:-

| | Attrition Reclaimed Sand | Thermally Reclaimed | New Sand |
|---|---|---|---|
| Loss on ignition | 1.8% | 0.15% | 0.2% |
| Potassium | 0.12% | 0.06% | 0.01% |
| Compression Strengths (psi) | | | |
| 1 hour | 21 | 36 | 29 |
| 2 hours | 54 | 80 | 72 |
| 4 hours | 134 | 283 | 238 |
| 24 hours | 235 | 420 | 460 |

EXAMPLE 3 (Comparative)

Adopting the same procedures as in Example 1 2.5% of water containing a small addition of a wetting agent (surfactant) to facilitate wetting of the sand was mixed with the sand.

The sand was then charged into the fluidised bed thermal reclaimer with an average bed temperature of 730° C.

The attrition reclaimed sand with this additive was found to agglomerate in the thermal reclaimer. The agglomerated mass within the reclaimer prevented normal discharge and terminated the test.

The sand was removed from the thermal reclaimer and found to be only loosely agglomerated at ambient temperatures. The potassium level of this reclaimed sand was found to be very similar to the attrition sand and little benefit from this treatment was obtained. Re-bonding properties were identical to the attrition reclaimed sand.

EXAMPLE 4 (Comparative)

This test involved charging the attrition reclaimed sand without a prior addition in to the thermal reclaimer. The thermal reclaimer was run at the same conditions as previous tests.

The attrition reclaimed sand agglomerated in the thermal reclaimer and terminated the test as in Example 3. The potassium level and re-bonding properties of the resulting sand was very similar to that of the attrition reclaimed sand.

EXAMPLE 5

The procedures of Example 1 were repeated using hydrochloric acid of varying concentrations and other acids and differing reaction conditions. The details of the additive and reactor conditions are tabulated below:

| Run | Additive | Concentration of acid solution(%) | Rate of Addition (% by wt of sand) | Temperature (°C.) |
|---|---|---|---|---|
| 1 | HCl | 10 | .2 | 760 |
| 2 | HCl | 10 | 2 | 850 |
| 3 | HCl | 10 | 1 | 760 |
| 4 | $H_2S_1F_6$ | 10 | 1 | 730 |
| 5 | HCl | 10 | 2 | 750 |
| 6 | HCl | 28* | 0.8 | 750 |
| 7 | $H_2SO_4$ | 26† | 0.7 | 750. |

*Commercial Concentration
†Battery Acid Concentration

The resulting treated sands of Runs 1 to 4 were then tested as described in Example 1 and the results are set out below:

| Attrition Sand (no additive) | |
|---|---|
| Loss on ignition = | 1.8% |
| Potassium = | 0.12% |
| Run 1 | |
| Loss on ignition = | 0.10% |
| Potassium = | 0.07% |
| Chloride ion = | 0.05% |

Bonding strengths were not determined.

| Run 2 | |
|---|---|
| Loss on ignition = | 0.04% |
| Potassium = | 0.07% |
| Chloride ion = | 0.03% |

The bed showed signs of sintering but did not block up. Sintering dispersed when the temperature was reduced to 760° C. (note melting point of KCl is 776° C.). Bonding strengths were not determined.

| Run 3 | |
|---|---|
| Loss on ignition = | 0.09% |
| Potassium = | 0.11% |
| Chloride ion = | 0.02% |

Bonding strengths were not determined.

| Run 4 | |
|---|---|
| Loss on ignition = | 0.09% |
| Potassium = | 0.10% |
| Floride ion = | 0.008% |

The treated sand of Run 4, the attrition sand noted above, and new sand were then subjected to bonding tests as described in Example 1 using the resin and hardener as described in Example 1. The resulting compression strengths (p.s.i.) are tabulated below:

| After (h) | New | Attrition | Thermal |
|---|---|---|---|
| 1 | 262 | 90 | 287 |
| 1 | 294 | 147 | 312 |
| 4 | 412 | 186 | 430 |
| 24 | 586 | 202 | 603 |

As can be seen the sand treated according to the invention gave bonding strengths comparable to new sand and very much better than sand treated solely by attrition.

The resulting treated sands of Runs 5 to 7 were then tested as described in Example 1 except that for bonding Novaset 720 (1.5% by weight of sand) and (NH10S hardener (25% by weight of resin) were used. The results, as compared with sand subjected to attrition only and new sand are set out below:

| Attrition Only | | | | |
|---|---|---|---|---|
| Loss on Ignition = | | | 1.45% | |
| Potassium = | | | 0.24% | |
| Chloride ion = | | | 0.0002% | |
| Compression Strengths (p.s.i.) | | | | |
| After (h) | 1 | 2 | 4 | 24 |
| | 131 | 174 | 203 | 268 |
| New Sand | | | | |
| Loss on Ignition = | | | 0.22% | |
| Potassium = | | | 0.01% | |
| Compression Strengths (p.s.i.) | | | | |
| After (h) | 1 | 2 | 4 | 24 |
| | 326 | 435 | 566 | 609 |
| Run 5 | | | | |
| Loss on Ignition = | | | 0.09% | |
| Potassium = | | | 0.10% | |
| Chloride ion = | | | 0.07% | |
| Compression Strengths (p.s.i.) | | | | |
| After (h) | 1 | 2 | 4 | 24 |
| | 319 | 479 | 537 | 740 |
| Run 6 | | | | |
| Loss on Ignition = | | | 0.08% | |
| Potassium = | | | 0.13% | |
| Chloride ion = | | | 0.06% | |
| Compression Strengths (p.s.i.) | | | | |
| After (hr.) | 1 | 2 | 4 | 24 |
| | 348 | 428 | 478 | 769 |
| Run 7 | | | | |
| Loss on Ignition = | | | 0.04% | |
| Potassium = | | | 0.17% | |
| Sulphur = | | | 0.06% | |
| Compression Strengths (p.s.i.) | | | | |
| After (h) | 1 | 2 | 4 | 24 |
| | 355 | 442 | 452 | 679 |

EXAMPLE 6

Following a similar procedure to that of Example 5, attrition reclaimed sand was well mixed with 1% by weight of powdered calcium sulphate. The resulting mixture was then heated in the fluidised bed at a temperature of 750° C. The sand did not agglomerate.

The resulting treated sand was then tested and bonding tests similar to those of Runs 5 to 7 of Example 6 were made. The results were as follows:

| | |
|---|---|
| Loss on Ignition = | 0.09% |
| Potassium = | 0.15% |
| Sulphur = | 0.08% |

-continued

| Compression Strengths (p.s.i.) | | | | |
|---|---|---|---|---|
| After (h) | 1 | 2 | 4 | 24 |
| | 168 | 298 | 347 | 463 |

These results, when compared with the results for new and attritioned sand tested in Example 5, show good improvements, although the bonding strengths were lower than when the addition was added in liquid form. Possibly the reason for this is the retention of calcium compounds in the sand.

These results demonstrate that the production of the thermally stable salt does appear to be the mechanism by which sintering is avoided. The potassium chloride appeared to sinter when the temperature was 850° C. but not when the temperature was reduced to 760° C. (see Run 2)

Also a wide range of concentrations and addition levels will enable the sand to be thermally reclaimed. Reducing the overall chloride level reduced the chloride ion content of the reclaimed sand, and resulted in a greater quantity of retained potassium. Similarly using a smaller addition of a more concentrated additive reduced salt production efficiency somewhat. However perfectly usable sand was produced.

Thus there should be sufficient addition to provide enough salt to avoid sintering, and preferably sufficient addition to wet the sand without too much excess water.

We claim:

1. A process comprising the thermal treatment of attrition reclaimed ester-cured phenolic resin bonded sand characterised in that prior to the thermal treatment the attrition reclaimed sand is contacted with an compound which converts potassium compounds to a form having a melting point of at least 550° C. and the thermal treatment is effected at a temperature below that at which the resulting potassium compound fuses.

2. A process as claimed in claim 1 in which the compound converts potassium compounds to a form having a melting point above 700° C.

3. A process as claimed in claim 1 or claim 2 in which the compound is contacted with the sand in the form of an aqueous solution.

4. A process as claimed in any preceding claim in which the compound is selected from one or more of halogen acids, sulphuric acid, boric acid and ammonium salts of these acids.

5. A process as claimed in claim 1 or claim 2 in which the compound is in the form of a powdered solid.

6. A process as claimed in claim 5 in which the compound is a calcium compound.

7. A process as claimed in any preceding claim in which the compound is used in an amount of at least 0.25% by weight of the attrition reclaimed sand.

8. A process as claimed in any preceding claim in which the compound is used in an amount in the range from 0.5 to 5% by weight of attrition reclaimed sand.

9. A process as claimed in any preceding claim in which the thermal treatment is conducted at a temperature of 600° to 1000° C.

10. A process as claimed in claim 9 in which the thermal treatment is conducted at a temperature of 700° to 800° C.

* * * * *